US006694110B2

(12) United States Patent
Akashi et al.

(10) Patent No.: US 6,694,110 B2
(45) Date of Patent: Feb. 17, 2004

(54) IMAGE FORMING APPARATUS WITH VARIABLE WAITING TIME CONVEYANCE FEATURE

(75) Inventors: Kazukiyo Akashi, Saitama (JP); Takeo Yamamoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/068,840

(22) Filed: Feb. 11, 2002

(65) Prior Publication Data

US 2002/0159783 A1 Oct. 31, 2002

(30) Foreign Application Priority Data

Feb. 19, 2001 (JP) ..... 2001-041906

(51) Int. Cl.[7] ..... G03G 15/00; G03G 15/02
(52) U.S. Cl. ..... 399/50; 399/394; 399/396
(58) Field of Search ..... 399/50, 76, 394, 399/396; 347/139, 140; 358/1.5

(56) References Cited

U.S. PATENT DOCUMENTS 4,894,669 A * 1/1990 Sugiura et al. ..... 347/129
5,694,158 A * 12/1997 Kato et al. ..... 347/139
5,978,643 A * 11/1999 Uno ..... 399/50
6,047,145 A * 4/2000 Shigezaki et al. ..... 399/50
6,101,343 A * 8/2000 Satoh et al. ..... 399/50
6,389,243 B2 * 5/2002 Makino

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus includes an image bearing member, an electrifying member for electrifying the image bearing member; an image forming member for forming an image on the image bearing member electrified by the electrifying member; a conveying member for making a recording material, which has been conveyed from a recording material receiving portion held in waiting and waiting then conveying the image on the image bearing member to a transfer portion for transferring the image onto the recording material; and a control member controls a start timing of electrification by the electrifying member in accordance with a start timing of a conveyance of the recording material by the conveying member.

10 Claims, 7 Drawing Sheets

IMAGE FORMING APPARATUS WITH VARIABLE WAITING TIME CONVEYANCE FEATURE

BACKGROUND OF THE INVENTION

1. Field of the Invention

The present invention relates to an image forming apparatus for forming an image by using an electrophotographic system or an electrostatic recording system, and particularly relates to an image forming apparatus, such as a copying machine, a printer or a facsimile.

2. Related Background Art

An image forming apparatus such as an electrophotographic apparatus (a copying machine, a laser printer or the like) or an electrostatic recording apparatus is known in which: an image forming process that includes a step of conducting electrification processing to an image bearing member is applied to an image bearing member such as an electrophotographic photosensitive member or an electrostatic recording dielectric of rotary drum type or endless belt type, to thereby form an electrostatic latent image corresponding to target image information; the electrostatic latent image is visualized (into a toner image) by a developer; the toner image is transferred to a recording material and further fixed to be output as an image formed material (copy, print); and the image bearing member is repeatedly used for image formation.

In such an image forming apparatus, a corona discharge device has been conventionally and widely used as a means for electrifying the image bearing member (hereinafter referred to as photosensitive member). The corona discharge apparatus is arranged so as to oppose the photosensitive member in a noncontact manner, and the surface of the photosensitive member is exposed to a corona shower emitted from the corona discharge apparatus to which a high voltage is applied, thereby making the photosensitive member surface undergo corona electrification.

In recent years, a contact type electrifying apparatus can attain a lower voltage of a power source in comparison with the corona discharge apparatus, and thus has advantages such as reduced amount of ozone generation. As a result, the contact type electrifying apparatus has been attracting attention and has been put to practical use.

In the contact type electrifying apparatus, a roller type (electrifying roller), a blade type, a fur-brush type, or a magnetic brush type conductive electrifying member (contact electrifying means) is made to contact with a member to be electrified such as the image bearing member, and a predetermined bias voltage is applied to the electrifying member, thereby electrifying the member to be electrified with predetermined polarity and potential.

A method in which a bias applied to the electrifying member is only a direct current voltage (DC application method) and a method in which a bias applied to the electrifying member is a voltage obtained by superimposing a direct current voltage on an alternating voltage (AC application method) are given. Particularly, the latter AC application method has been widely used in recent years since an alternating component makes unevenness of electrification uniform and a direct current component converges a voltage to a predetermined level, thereby easily obtaining uniformity of a surface potential.

Two kinds of contact electrification mechanisms, that is, corona electrification system and direct electrification system (charge injection electrification system), are mixedly present. The characteristic of contact electrification appears depending on which electrification system is dominant.

By the way, in the image forming apparatus using the contact electrifying apparatus, electrification of the photosensitive member must have been previously started before image formation. Specifically, unless electrification has been previously started and performed for at least a period for one peripheral length of the rotating photosensitive member, the electrification potential is unstable, and it is difficult to obtain a satisfactory image with uniform image density. Thus, in the case where a synchronizing means of a recording material is located close to an image forming part, the electrification is required to start at the position of a sensor in an upstream side of the image forming part or with a reference signal. At this time, for example, in the case where a time is required for image processing or in the case where activating of another apparatus, for example, a fixing apparatus in the image forming apparatus is on stand-by, a recording material is always caused to wait at the position of the synchronizing means. If the recording material is not caused to wait at the position for the synchronization, an excess amount of time is required until image formation is completed after the preparation for image formation is completed, whereby an unpleasant feeling is given to a user. That is, if feeding of the recording material is started after preparations for the image forming apparatus are completed, an excess amount of time is needed from the start of image formation until the completion by that amount of time.

Particularly in the image forming apparatus mounted with a memory apparatus for recording image data, for example, in the case where a plurality of sheets of image outputs are obtained based on a sheet of original, or at the time of reading of a double-sided original or at the time of image formation for both surfaces of a sheet, time may be required for image data processing such as accumulation/expansion of memory. When the above-described image formation is performed at this time, a still another excess time will become necessary, thereby increasing a load on the user.

On the other hand, if the recording material is caused to wait at the position of the synchronizing means at this time, an electrification bias is excessively applied to the photosensitive member until the preparation of image data for the first image formation is completed after the accumulation/expansion of memory is completed. As a result, power is consumed unnecessarily.

Here, it has been found through an examination by the present inventors that there exists a proportional correlation between an application time of an electrification bias (particularly AC component) and an abrasion amount of a surface layer of the photosensitive member in the image forming apparatus using the contact electrifying apparatus. Therefore, when the photosensitive member is excessively electrified, abrasion of the surface layer is promoted. Thus, the service life of the photosensitive member becomes short.

That is, there has been a problem in that, when an excess time in the image data processing or in the activating of the image forming apparatus and an excess waiting time of the recording material at the position for synchronization are caused, electric power necessary for electrification is wastefully consumed, which leads to a short life of the photosensitive member.

SUMMARY OF THE INVENTION

The present invention has been made in view of the above, and an object of the present invention is therefore to provide an image forming apparatus capable of reducing consumption of power necessary for electrification of an image bearing member as much as possible.

Another object of the present invention is to provide an image forming apparatus capable of extending a life of the image bearing member.

Other objects of the present invention will be apparent by reading the following detailed description with reference to the accompanying drawings.

DESCRIPTION OF THE PREFERRED EMBODIMENTS

[Embodiment 1]

(1) Schematic Structure of Example of Image Forming Apparatus

Figure 1:
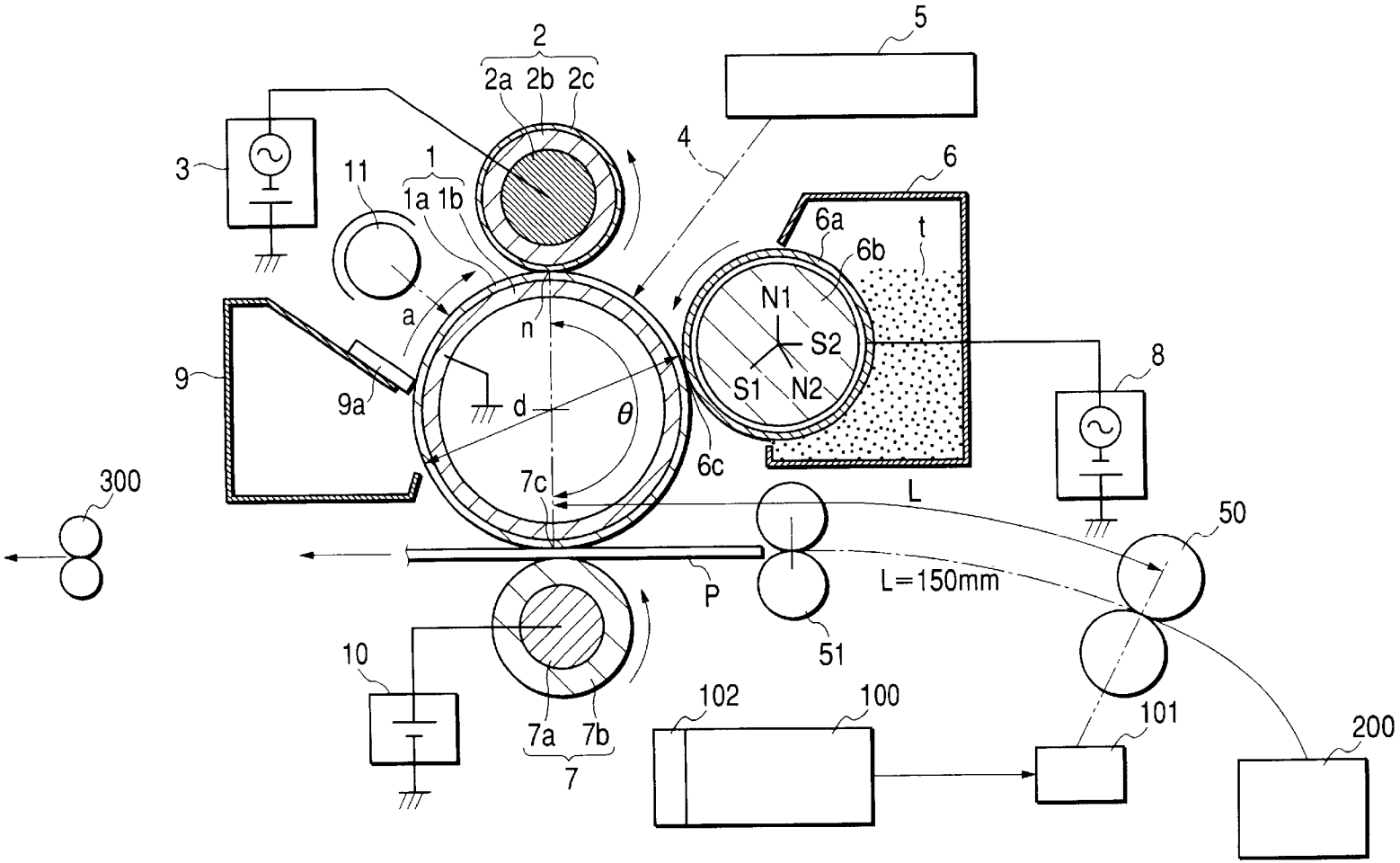
FIG. 1 is a schematic structural diagram showing an image forming apparatus in accordance with Embodiment 1.

FIG. 1 is a schematic structural diagram showing an image forming apparatus according to this embodiment. The image forming apparatus in this embodiment is a laser beam printer utilizing a transfer electrophotographic process, a contact electrification system, and a reversal developing system.

[Photosensitive Member]

Reference numeral 1 denotes a rotation drum type electrophotographic photosensitive member (hereinafter referred to as photosensitive member for short) as an image bearing member.

The photosensitive member 1 in this embodiment is an OPC photosensitive member (negative photosensitive member) of negatively charged polarity with a diameter d=30 mm and a length of 350 mm which is constituted of a conductive drum base member 1*b* made from aluminum or the like and a surface layer (optical conductive layer) 1*a* formed on a peripheral surface of the conductive drum base member 1*b*. The photosensitive member 1 is rotatively driven at a process speed (peripheral velocity) of 150 mm/sec in a clockwise direction indicated by an arrow a. Further, the photosensitive member including the surface layer la with a thickness at an initial stage of 30 $\mu$m is used.

[Electrification]

Reference numeral 2 denotes an electrifying roller as a contact electrifying member (contact electrifying means, primary electrifying apparatus). The electrifying roller 2 is a roller with a composite-layer structure which is constituted of a core bar 2*a* as the center, an elastic conductive layer 2*b* formed into a roller shape concentrically and integrally with a peripheral surface of the core bar 2*a,* and a resistance layer 2*c* further formed on a peripheral surface of the elastic conductive layer 2*b*.

The elastic conductive layer 2*b* is a single layer or a composite layer formed of conductive rubber (EPDM or the like) of $10^4$ Ωcm or less, for example.

The resistance layer 2*c* is a single layer or a composite layer made of hydrin rubber or TORESIN (trade name, nylon resin, carbon dispersion) with $10^7$ to $10^{11}$ Ωcm and with a thickness of 100 $\mu$m or less. The resistance layer 2*c* plays a function of preventing a leak to the photosensitive member 1 and preventing bleeding of a plasticizer in the elastic conductive layer 2*b*.

Both end portions of the core bar 2*a* of the electrifying roller 2 are rotatably borne on a bearing member (not shown), and the electrifying roller 2 is arranged in parallel with the drum type photosensitive member 1 and is allowed to pressure-contact with the photosensitive member 1 with a predetermined pressing force by a pressing means (not shown). In this embodiment, the electrifying roller 2 rotates in a counterclockwise direction indicated by an arrow in association with the rotation drive of the photosensitive member 1. A contact nip portion n between the photosensitive member 1 and the electrifying roller 2 corresponds to an electrifying area position (hereinafter referred to as electrifying nip portion).

Reference numeral 3 denotes an electrification bias application power source (power source for the electrifying member). A predetermined bias voltage is applied to the core bar 2*a* of the electrifying roller 2 from the power source 3. Thus, the peripheral surface of the rotary photosensitive member 1 is uniformly electrified with predetermined polarity and potential by the contact electrification system.

In this embodiment, an AC application method is adopted in which a bias voltage (AC+DC) obtained by superimposing a direct current voltage on an alternating voltage is applied to the electrifying roller 2. An AC current component is set so that the photosensitive member 1 and the electrifying roller 2 can attain uniformity of electrification in an initial state. In this embodiment, in conducting uniform electrification to the surface of the photosensitive member 1, control with a direct current voltage component: a constant voltage of −750 V and an alternating current component: a frequency of 1800 Hz and a constant current of 1500 $\mu$A is conducted to the electrifying roller 2, thereby obtaining −730 V as a surface potential (electrification potential, dark portion potential (nonexposure portion)) of the photosensitive member 1.

[Exposure]

Image exposure 4 is performed to the electrified surface of the rotary photosensitive member 1 by an exposure means 5 in accordance with input image data input to the image forming apparatus, whereby an electrostatic latent image corresponding to the image information is formed. The exposure means 5 is a laser beam scanning exposure means, a slit exposure means of an original image, or the like. In this embodiment, the laser beam scanning exposure means is used.

[Developing]

Next, a developer is applied to the surface of the rotary photosensitive member 1, on which the electrostatic latent image is formed by a developing apparatus 6, and thus, the electrostatic latent image is developed as a toner image. In this embodiment, minus toner (negative toner) is adhered onto a light portion of the thus exposed electrostatic latent image, whereby the electrostatic latent image is reversely developed.

The developing apparatus 6 in this embodiment is an apparatus of jumping developing system using one-component magnetic toner. Reference numeral 6*a* denotes a nonmagnetic developing sleeve, which is arranged so as to oppose the photosensitive member 1 through a gap of 0.3 mm and is rotatively driven in a counterclockwise direction indicated by an arrow. Reference numeral 6*b* denotes a nonrotary magnet roller insertingly arranged in the developing sleeve 6*a*.

Toner t received in the developing apparatus is applied onto a peripheral surface of the developing sleeve 6*a* along with the rotation to thereby form a thin layer, and is held by a magnetic force of the magnet roller 6*b* to be carried to a developing part 6*c* where the photosensitive member 1 and the developing sleeve 6*a* oppose each other. Further, in this embodiment, as a developing bias voltage, a superimposed voltage:

| | |
|---|---|
| DC component: | −500 V |
| AC component: | frequency of 1800 Hz, Vpp (peak to peak) of 1400 V |

is applied to the developing sleeve 6*a* from a developing bias application power source 8 (power source for a developing member).

Thus, the toner flies at the developing part 6*c*, and the electrostatic latent image formed on the surface of the rotary photosensitive member 1 undergoes jumping developing.

[Transfer]

Reference numeral 7 denotes a transferring roller as a transfer means. The transferring roller 7 is constituted of a core bar (mandrel) 7*a* at the center and a middle-resistance elastic layer 7*b* formed into a roller shape concentrically and integrally with a peripheral surface of the core bar 7*a*. The transferring roller 7 in this embodiment is a conductive rubber roller with resistance of $5\times10^8$ Ω and a diameter of 16 mm.

Both end portions of the core bar 7*a* of the transferring roller 7 are rotatably borne on a bearing member (not shown), 7 and the transferring roller 7 is arranged in parallel with the drum type photosensitive member 1 and is allowed to pressure-contact with the photosensitive member 1 with a predetermined pressing force applied by a pressing means (not shown). In this embodiment, the transferring roller 7 rotates in a counterclockwise direction indicated by an arrow in association with the rotation drive of the photosensitive member 1. A contact nip portion 7*c* between the photosensitive member 1 and the transferring roller 7 corresponds to a transfer area position (hereinafter referred to as transfer nip portion).

The recording material P is fed from a sheet feeding portion 200 as a recording material receiving portion. The fed recording material P is caused to wait for a certain period of time by a pair of rollers for synchronizing (registration rollers) 50 as a synchronizing means (conveying means), and starts to be fed to the transfer nip portion 7*c* at a certain timing. That is, the recording material P starts to be fed to the transfer nip portion 7*c* at a timing such that, when a tip end portion of the toner image formed on the surface of the rotary photosensitive member 1 reaches the transfer nip portion 7*c*, a tip end portion of the recording material P also reaches the transfer nip portion 7*c* at exactly the same time.

The surface of the recording material P fed to the transfer nip portion 7*c* adheres to the rotary photosensitive member 1, and the recording material P is sandwiched at and conveyed through the transfer nip portion. Further, from the time when the tip end portion of the recording material P reaches the transfer nip portion 7*c* until a rear end portion thereof passes through the transfer nip portion 7*c*, a predetermined direct current bias with a polarity opposite to that of the toner is applied as a transfer bias to the core bar 7*a* of the transferring roller 7 from a transfer bias application power source (power source for a transferring member). A DC voltage of +3500 V is applied in this embodiment.

Then, in the process in which the recording material P is sandwiched at and conveyed through the transfer nip portion 7*c*, the toner image on the rotary photosensitive member 1 side is sequentially transferred onto the recording material P due to the action of a transfer electric field formed by the transferring roller 7 and a pressing force applied to the transfer nip portion 7*c*.

[Fixation]

The recording material P which has passed through the transfer nip portion 7*c* and has been separated from the surface of the rotary photosensitive member 1 is conveyed to a fixing apparatus 300, and is fixed with a toner image. Then, the recording material P is discharged to the outside of the apparatus main body. Alternatively, for example, if an image is to be formed also on the back surface, the recording material P is conveyed to a re-conveying means (not shown) to the transfer nip portion.

[Cleaning]

The surface of the rotary photosensitive member 1 after the recording material separation is cleaned by being removed of residual attaching contaminant such as paper powder or toner remaining on the surface of the photosensitive member 1 without being transferred to the recording material P (transfer residual toner) by a cleaning blade 9*a* of a cleaning apparatus 9. Further, the surface is subjected to full exposure (pre-exposure) by a charge-removal device (charge-removal lamp) 11 to undergo erasing of electric memory to be initialized. Thus, the surface of the photosensitive member 1 can be repeatedly used for image formation.

In this embodiment, the electrifying roller 2 and the transferring roller 7 are each rotated in association with the photosensitive member 1. However, each of the rollers may be attached with a gear or the like and may be forcedly driven by a drive means such as a motor.

Reference numeral 100 denotes a control circuit portion (control means) of the image forming apparatus. The image forming apparatus is sequence-controlled by the control circuit portion 100 in a predetermined manner. Reference numeral 101 denotes a drive portion of the pair of rollers for synchronizing 50, which is constituted of a clutch/motor and the like. The drive portion 101 is controlled by the control circuit portion 100, whereby the drive of the pair of rollers for synchronizing 50 is on/off-controlled at predetermined timing (on: rotation (sheet feeding), off: rotation stop (waiting for sheet feeding). That is, the control circuit portion 100 controls start timing for feeding the recording material P caused to wait at the pair of rollers 50.

(2) Control of Electrification Bias

As described above, in the image forming apparatus of contact electrification system, it is preferable that electrification is performed for a period for one peripheral length of the photosensitive member prior to image formation (before formation of an electrostatic latent image by image exposure) taking into consideration uniformity of the electrification potential of the photosensitive member surface.

Further, it is not essential but is desirable that electrification for a period for one peripheral length of the photosensitive member is conducted also after the completion of image formation in order to conduct transfer or reduce exposure memory.

For this reason, in the structure of this embodiment, the photosensitive member 1 has the diameter d of 30 mm, a traverse length (short side) of an A4 sheet of 210 mm, and a process speed (peripheral velocity of the photosensitive member) of 150 mm/sec. Therefore, the total sum of (A)+(B)+(C)=2.66 sec, where:

(A) before image formation: 30×3.14/150=0.63 sec;

(B) at the time of image formation: 210/150=1.4 sec; and (C) after image formation: 30×3.14/150=0.63 sec, is the minimum photosensitive member electrification time necessary for forming an image on one sheet of the recording material of A4 traverse.

Further, the structure, or sequence is adopted in which image formation may be performed for 30 sheets of A4 traverse per minute. The distance between recording materials, that is, sheet interval in continuous image formation for a plurality of recording materials is controlled at 90 mm (0.6 sec).

Then, image formation is conducted with the structure of the image forming apparatus in this embodiment shown in FIG. 1. In this structure, the pair of rollers for synchronizing 50 are arranged at a distance of 150 mm along a recording material conveying path from the transfer nip portion 7*c* on the upstream side in a recording material conveying direction from the transfer nip portion 7*c*. That is, it is set that L=150 mm.

Further, in order to secure conveyance stability of the recording material P, a pair of follower rollers 51 are arranged at the position at a distance of 40 mm along the recording material conveying path from the transfer nip portion 7*c* between the transfer nip portion 7*c* and the pair of rollers for synchronizing 50. Moreover, in this embodiment, a sensor for detecting passage timing of the tip end of the recording material P is arranged at the position of the pair of follower rollers 51, and image exposure is started by instruction from the control circuit portion 100 on the basis of the sensor output.

Furthermore, an angle θ formed by the electrifying nip portion n and the transfer nip portion 7*c* in the photosensitive member rotational direction is π radians or 180° (FIG. 1). Accordingly, the distance from the electrifying nip portion n to the transfer nip portion 7*c* can be expressed as $(d\times\theta)/2$. Substituting π for θ in the embodiment of FIG. 1, the distance from the electrifying nip portion n to the transfer nip portion 7*c* equals $(d\times\pi)/2$ or half of the peripheral length of the photosensitive member 1.

The peripheral length of the photosensitive member 1 plus the distance from the electrifying nip portion n to the transfer nip portion 7*c* is equal to L0. That is, $\mathbf{L0}=\pi d\times(1+\theta/2\pi)$. Namely, in this structure, the distance corresponding to one and a half times the peripheral length of the photosensitive member is L0, $\mathbf{L0}=\pi\times30\times\{1+180/360\}=141.3$ mm. Therefore, when electrification by the electrifying roller 2 is started by the control circuit portion 100 within a predetermined time on the basis of sheet feeding start timing of the pair of rollers for synchronizing 50 (in this embodiment, from the time when the pair of rollers for synchronizing 50 are turned on until the time (9.7 mm÷150 mm/sec=65 msec)) when the tip end of the recording material P is conveyed for L (150 mm)−L0(141.3 mm), the area to be the tip end portion and the subsequent portion of the image (electrostatic latent image) formed on the photosensitive member can be uniformly electrified in advance. Thus, so long as $L\geqq\mathbf{L0}$, image defect (electrification unevenness) can be prevented. Substituting for L0, this relationship becomes $L\geqq\pi d\times(1+\theta/2\pi)$, which reduces to $L\geqq\pi d+\theta d/2$. In other words, the difference between (i) a distance L from a conveyance start position of the conveying means 50 to the transfer nip portion 7*c* and (ii) a distance from the electrifying nip portion n to the transfer nip portion 7*c* is preferably equal to or more than a peripheral length of the photosensitive drum 1. This relationship can be expressed mathematically as $L-\theta d/2\geqq\pi d$.

Figure 2:
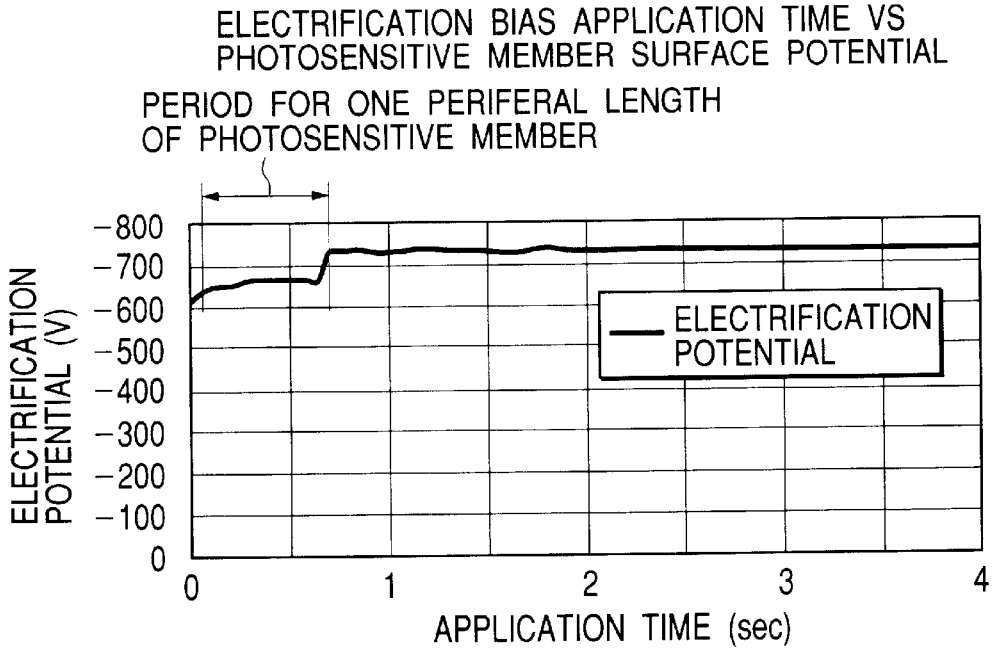
FIG. 2 is a graph showing a relationship between an electrification bias application time and a photosensitive member surface potential.

More specifically, as shown in FIG. 2, the electrification potential of the photosensitive member 1 after electrification has been performed for the period for one peripheral length is stable at −730 V. If image formation (exposure, developing, transfer and the like) is started at this point, the time required for discharging the recording material P on which the image is formed to the outside of the apparatus after input of an image forming start signal can be shortened as much as possible. Also, a satisfactory image with no fog and the like can be provided.

Then, by setting the sequence such that electrification is started after about 50 msec from the time when the pair of rollers for synchronizing 50 are turned ON (driven) in this structure, first, image formation from one sheet of original (one input image data) to one sheet (A4) of the recording material (hereinafter referred to as 1 to 1) is conducted using the original (A4) with a printing ratio of 6%. As a result, the electrification time required for the formation of an image on one sheet of the recording material is (A)+(B)+(C) about 2.7 sec based on the electrification time necessary for (A) before image formation, (B) at the time of image formation, and (C) after image formation, which are described above.

Note that the image forming apparatus in this embodiment has a printer function or a facsimile function for conducting image formation in accordance with image data transmitted from a computer connected through lines (networked) besides a copying function for copying an original.

Figure 3:
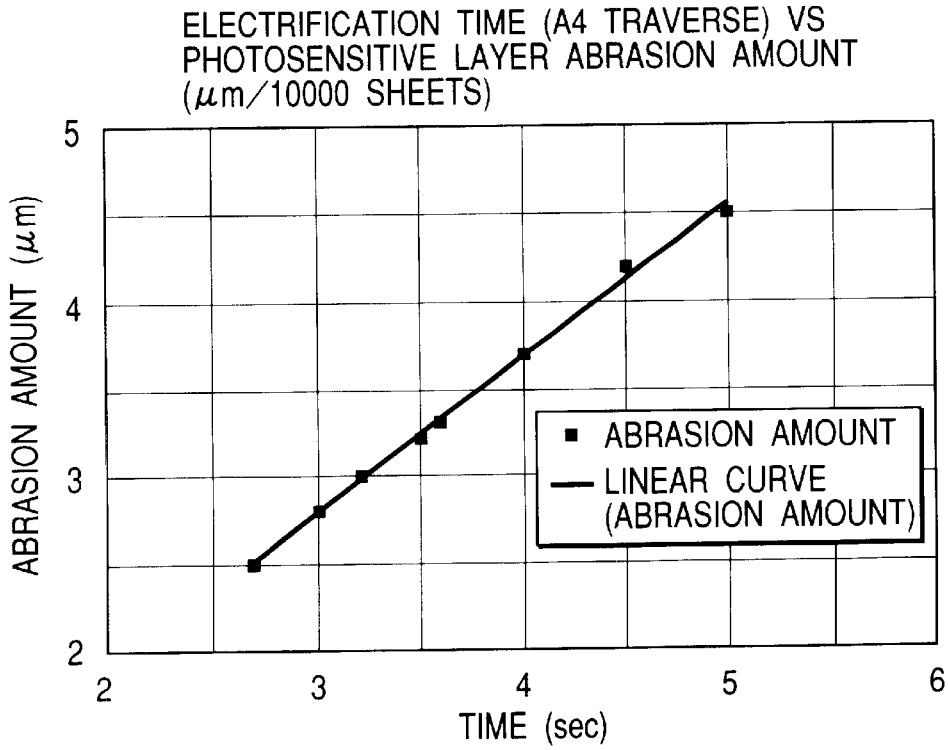
FIG. 3 is a graph showing a relationship between an electrification time per A4 sheet and a photosensitive member abrasion amount (per 10,000 sheets)

Here, as shown in FIG. 3, it is found through an examination by the present inventors that there exists a proportional relationship between an application time of an electrification bias (hereinafter referred to as electrification time) per A4 sheet and an abrasion amount (per 10,000 sheets) of a surface layer 1*a* of the photosensitive member 1 (photosensitive layer in this embodiment).

Further, in the photosensitive member 1 used in this embodiment, electrification performance decreases if the thickness of the remaining surface layer 1*a* becomes 10 μm or less, and thus, it becomes difficult to secure electrifying uniformity. When the electrification time per A4 sheet is 2.7 sec, the abrasion amount of the surface layer per 10,000 sheets is approximately 2.5 μm. Accordingly, as to the photosensitive member life, image formation for about 80 thousands sheets of A4 traverse is possible.

Furthermore, in the image forming apparatus, a 1 to N image forming mode described later can be selected in addition to the above-mentioned 1 to 1 image forming mode. Note that the 1 to 1 image forming mode differs from the 1 to N image forming mode described later in that the input image data input to the image forming apparatus is directly output to an exposure apparatus without going through a memory apparatus 102 described later. With such a structure, the period of time from the time when the image forming start signal is input until the recording material on which an image is formed is discharged to the outside of the apparatus is made to be as short as possible.

Next, image formation from one sheet of original (one input image data, which is the same as the input image data used in the 1 to 1 image forming mode described above) to N sheets (A4) of the recording material (this operation is hereinafter referred to as 1 to N) is conducted using the original (A4) with a printing ratio of 6%.

By the way, the image forming apparatus in this embodiment is provided with a memory apparatus 102 as memory means. This memory apparatus 102 is used for once accumulating image data therein and conducting developing, editing, and the like (image processing) to the image data by means of the control circuit portion 100, thereby outputting output image data that has undergone the processing to the image exposure apparatus, when image formation from one sheet of original to a plurality of sheets of the recording material is conducted as in 1 to N, for example. Thus, a difference is caused in an amount of the time required for processing an input image data to be output as the output image data, after the input image data is input in accordance with the image forming mode.

Further, because of the above-mentioned structure, in the image forming apparatus, the original does not need to be read N times in the 1 to N image forming mode. Thus, in recent years, such an image forming apparatus has been preferably used with advantages such as low noise and improved productivity of double-side image formation.

Furthermore, in this structure, after the image forming start signal is input, feeding of the recording material is started to the pair of rollers for synchronizing 50 from the sheet feeding portion 200 without waiting for the preparation time (a period of time required until the peripheral velocity of the photosensitive member becomes stable after the start of rotation, or the like) in starting the image formation.

On the other hand, a little time may be required for accumulation and expansion of the image data. In this embodiment, the recording material P is caused to wait at the pair of rollers for synchronizing 50 until the completion of accumulation and expansion of the image data. This is because the period of time required from input of the image forming start signal to discharging of the recording material P on which an image is formed to the outside of the apparatus is made short as much as possible. At this time, the total electrification time at the time of the image formation in 1 to 2 is 4.7 sec.

This is because electrification is not conducted to the photosensitive member while waiting for the completion of accumulation and expansion of data. Actually, in the memory apparatus used in this embodiment, an excess time of about 2 sec becomes necessary for the accumulation/expansion (D) of image data. However, when the recording material P is caused to wait at the position of the pair of rollers for synchronizing 50, and electrification start timing by the electrifying roller 2 is set with the start timing of feeding the recording material P as a reference, an excess electrification bias is not applied during the waiting. Thus, as to the total electrification time in 1 to 2, the electrification time of 2.7 sec for one sheet of A4 traverse in 1 to 1 is added with a period of time corresponding to the length of one sheet of A4 traverse plus the sheet interval, so that it is obtained as below:

$$210\ (\text{mm})+90\ (\text{mm})=300\ (\text{mm})$$

$$300\ (\text{mm})/150\ (\text{mm/sec})=2\ (\text{sec})\ (E).$$

Therefore, the total electrification time in 1 to 2 is (A)+(B)+(C)+(E) about 4.7 sec.

Namely, the total electrification time at the time of 1 to N ($N \geqq 2$) is $2.7+2\times(N-1)$. That is, the electrification time per sheet is $\{2.7+2\times(N-1)\}/N<2.7$, and is decreased as the number of N becomes larger.

Thus, in the image formation in 1 to 2, the electrification time per sheet of A4 traverse is 2.35 sec, and the number of sheets possible for image formation can be increased to 80 (thousands sheets)×2.7/2.35=92 (thousands sheets).

Figure 4:
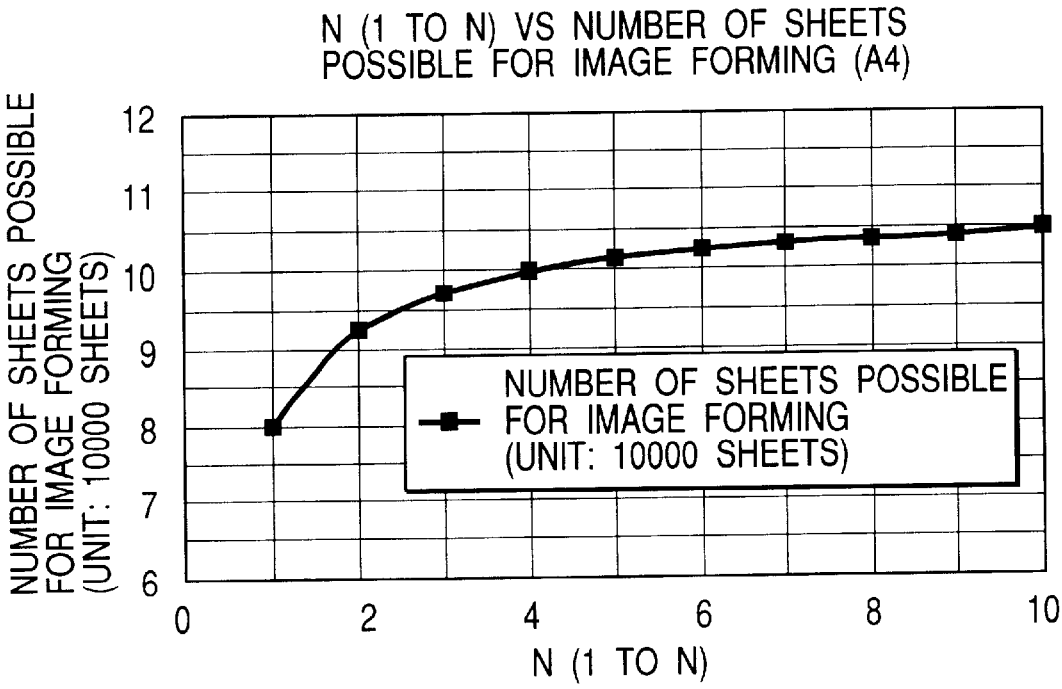
FIG. 4 is a graph showing a relationship between a number of N among 1 to N and the number of sheets possible for image formation (A4 traverse) in accordance with Embodiment 1.

FIG. 4 shows a relationship between N among 1 to N indicated in the horizontal axis and the number of sheets possible for image formation (A4 traverse) indicated in the vertical axis.

In this structure, the recording material is caused to wait at the pair of rollers for synchronizing 50 until the completion of image processing such as accumulation and expansion of the input image data input to the image forming apparatus, and the start timing of electrification of the photosensitive member is controlled in accordance with the start timing of feeding the recording material. Thus, the number of sheets possible for image formation per unit time can be stably maintained without depending on the image forming mode (for example, 1 to 1, 1 to N, a letter (standard image quality) mode (i.e., the case where only black letters are present in an image, that is, the mode in which the number of density levels (the number of gradation levels) of the output image data output to the exposure apparatus is small with respect to the input image data corresponding to the image of original), or a photographic (high image quality) mode (the mode focusing on the reproducibility of halftone, that is, the mode in which the number of density levels (the number of gradation levels) of the output image data to be output to the exposure apparatus is large with respect to the input image data).

Further, the number of sheets possible for image formation can be stably maintained without depending on the amount of the input image data corresponding to the image of original, for example, the printing ratio (the ratio of letters (the number of letters with the same printing density) in one page (predetermined surface area), that is, the amount of image data in one page (the total number of dots)).

Here, the image data corresponding to the image of original indicates the image data of original to be copied which is read by a scanner in case of using the image forming apparatus as a copying machine. In case of using the image forming apparatus as a printer or a facsimile, the image data corresponding to the image of original indicates the image data transmitted from the computer or the facsimile through lines.

[Comparative Example]

Figure 5:
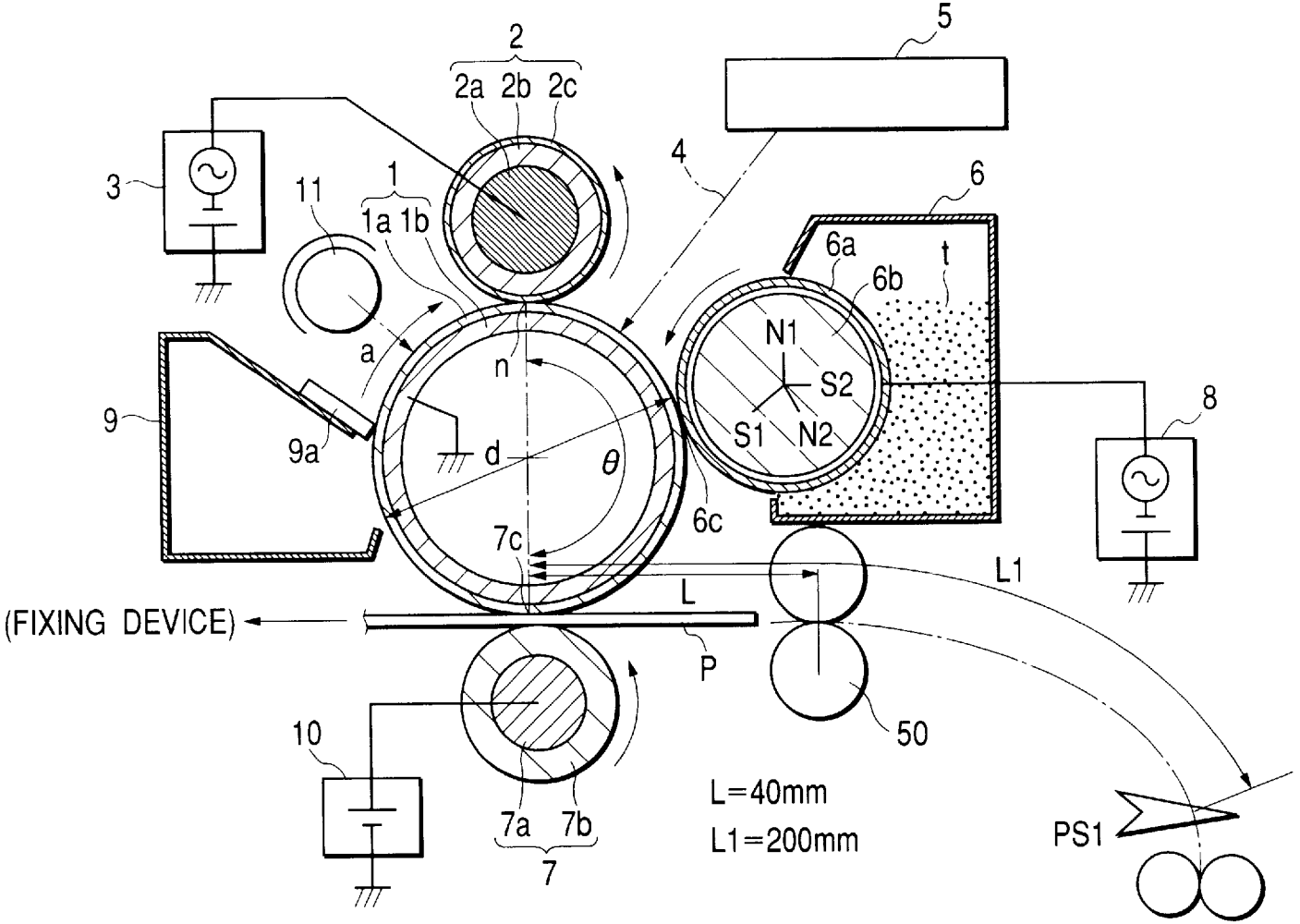
FIG. 5 is a schematic structural diagram showing an image forming apparatus in accordance with a comparative example (conventional example)

In a comparative example, image formation is similarly performed with the structure of a conventional example shown in FIG. 5. In this structure, a distance L between the nip position of the pair of rollers for synchronizing 50 and the transfer nip portion 7*c*, which is formed by the photosensitive member 1 and the transferring roller 7, is approximately 40 mm. Thus, if the pair of rollers for synchronizing 50 are set as the basis for the electrification start, a sufficient period of time for performing electrification for one peripheral length of the photosensitive member before the image formation cannot be obtained since L0=141.3 mm. That is, if the pair of rollers for synchronizing are regarded as the reference, electrification unevenness is generated, which leads to image unevenness. Thus, as shown in FIG. 5, a sensor (vertical path sensor) PS 1 after sheet feeding is arranged on the recording material conveying path on the downstream side in the recording material conveying direction with respect to the pair of rollers for synchronizing 50, and this is set as the reference for the electrification start. A distance L1 between the sensor PS1 and the transfer nip portion 7*c* along the recording material conveying path is 200 mm.

That is, since L0=141.3 mm, if electrification is started within a predetermined time with the passage through the sensor PS1 as a reference, the area to be the tip end portion and the subsequent portion of the image to be formed on the photosensitive member is previously electrified before image formation. Thus, image defect (electrification unevenness) can be prevented.

Then, by setting the sequence such that electrification is started at the point of time when the time corresponding to about 60 mm (400 msec) has elapsed since the tip end of the recording material P passed through the sensor PS1, the image formation in 1 to 1 for the original (A4) with a printing ratio of 6% is first conducted. As a result, the electrification time required for image formation for one sheet is about 2.7 sec as in Embodiment 1, and image formation for 80,000 sheets of A4 traverse becomes possible.

Next, similarly, the image formation in 1 to N is performed. Note that, here, in the conventional example as well, until the accumulation and expansion of image data are completed, the recording material P is caused to wait at the position of the pair of rollers for synchronizing 50. However, since the recording material P has passed through the sensor PS1 before being made to wait, the recording material P waits in the state that it is applied with an electrification bias.

The waiting time is about 2 sec as in Embodiment 1. Thus, the total electrification time in 1 to 2 is (A)+(B)+(C)+(D)+(E)=2.7+2+2 about 6.7 sec.

That is, the total electrification time in 1 to N is 2.7+2×(N−1)+2.

That is, in comparison with Embodiment 1, an excess electrification bias corresponding to the time (D) required for the accumulation and expansion of image data is applied to the photosensitive member 1.

Therefore, the electrification time per sheet is {2.7+2×(N−1)+2}/N, and the electrification time in 1 to 2 is 3.35 sec per sheet. At this time, the number of sheets possible for image formation is lowered to 80 (thousands)×2.7/3.35=64 (thousands).

Figure 6:
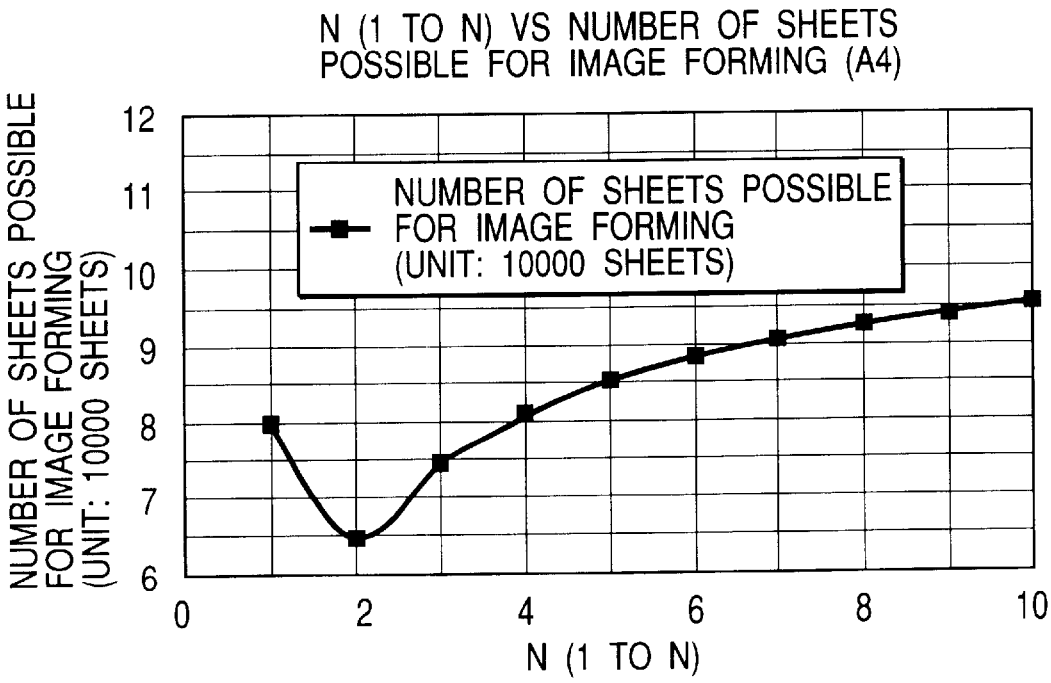
FIG. 6 is a diagram showing a relationship between a number of N among 1 to N and the number of sheets possible for image formation (A4 traverse) in accordance with the comparative example.

FIG. 6 shows a relationship between the number of N among 1 to N indicated in the horizontal axis and the number of sheets possible for image formation (A4 traverse) indicated in the vertical axis. According to the graph, the number of sheets possible for image formation becomes below the number of sheets possible for image formation in 1 to 1, that is, 80,000 sheets, up until the image formation of 1 to 4.

By the way, the time required for expansion and accumulation of image data in the above-mentioned memory apparatus varies according to the printing ratio, a determination as to whether the halftone is reproduced or not, or the like. Thus, 2 sec does not always serve as the reference. Therefore, it is impossible to control the sheet feeding timing based on an estimation of that time.

Further, in the case where the feeding of the recording material P is started from the sheet feeding portion 200 after the completion of expansion of image data, the productivity (the time required until the first recording material is discharged to the outside of the apparatus, and the like) considerably drops, causing consternation to a user.

As a result, in case of the original with a high printing ratio or in case of the high image quality mode in which the halftone is reproduced at a higher density, the time for the image processing such as accumulation and expansion of input image data is further required. Thus, the number of sheets possible for image formation becomes below 80,000 until N becomes even larger.

That is, in Embodiment 1, the number of sheets possible for image formation can be appropriately kept irrespective of the image forming mode (for example, the value of N in the image forming mode in 1 to N).

In this embodiment, the means for synchronizing is arranged at the position at a distance of 150 mm from a transfer region, that is, with L=150 mm, but the same effect can be obtained as long as L is longer than L0 (141.3 mm). However, taking the effect of saving space and the productivity of the image forming apparatus into consideration, L is desirably twice the value of L0 or less. More preferably, if it is substantially equal to L0 (that is, electrification of the photosensitive member is started by the electrifying roller 2 simultaneously with the timing at which sheet feeding by the pair of rollers for synchronizing 50 is started), this becomes substantially the optimum structure.

[Embodiment 2]

In Embodiment 1, the number of sheets possible for image formation can be prevented from decreasing at the time of image formation in 1 to N. However, the position of the pair of rollers for synchronizing 50, that is, the waiting position of the recording material P is relatively far from the transfer area, and thus, it takes approximately 0.7 sec until the first recording material P is discharged to the outside of the image forming apparatus after the input of the image forming start signal. Therefore, there may be the case where the productivity of image formation with respect to the first recording material drops.

This is because, in 1 to N (N≧2), since the waiting position in Embodiment 1 is at a distance of 141.3 mm from the transfer area, and the waiting position of the recording material in the comparative example is at a distance of 40 mm from the transfer area, the waiting time becomes longer by (141.3−40)/150=0.68 sec.

Figure 7:
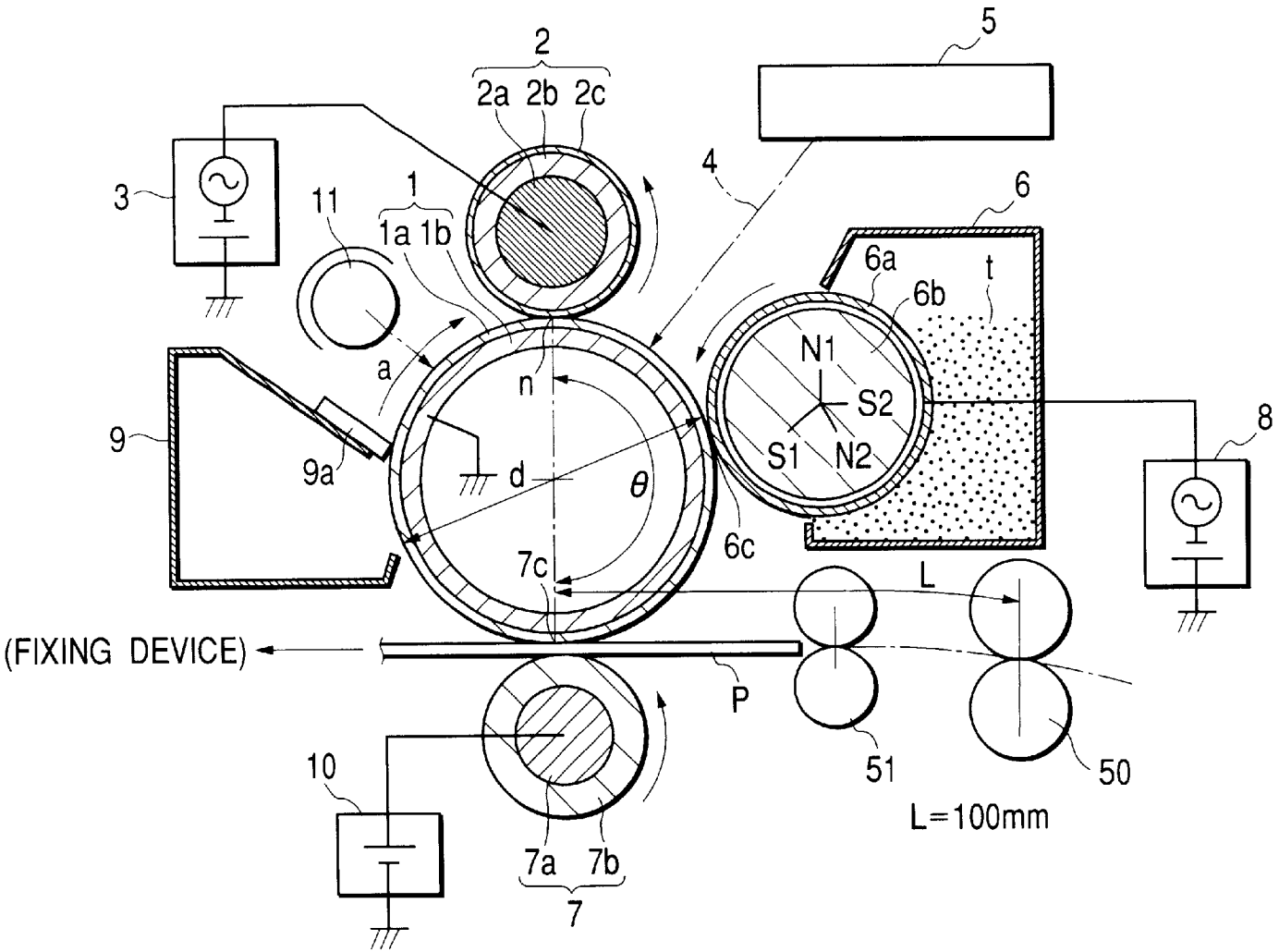
FIG. 7 is a schematic structural diagram of an image forming apparatus in accordance with Embodiment 2.

Then, in this embodiment, as shown in the structure of FIG. 7, the pair of rollers for synchronizing 50 are arranged at the position at a distance of L=100 mm from the transfer nip portion 7*c*, and a sequence is adopted in which electrification is started with ON (drive) of the pair of rollers for synchronizing 50 as a reference. Further, at this time, while the photosensitive member 1 rotates for a period for one peripheral length with the start of ON of the pair of rollers for synchronizing 50, the peripheral velocity of the photosensitive member 1 is set at double the speed, that is, 300 mm/sec. This is for completing the electrification for one peripheral length of the photosensitive member until the beginning of writing of an image. It is found through the examination by the present inventors that the electrifying uniformity is somewhat deteriorated during the electrification at double the speed in comparison with a case of maintaining the peripheral speed to a constant process speed, but is sufficient for obtaining the electrifying uniformity after the rotation for one peripheral length.

Namely, a time t1 required until the tip end of the first recording material reaches the transfer area after passing through the means for synchronizing is t1=100/150=0.67 sec, and a time t0 required for movement by L0 until, from the time when the electrification of the photosensitive member is started until the area of the photosensitive member to which the electrification has been started passes through the electrification area again to reach the transfer region (=π×30×(1+180/360)) is t0=π×30×(1+180/360)/300=0.47 sec.

Figure 8:
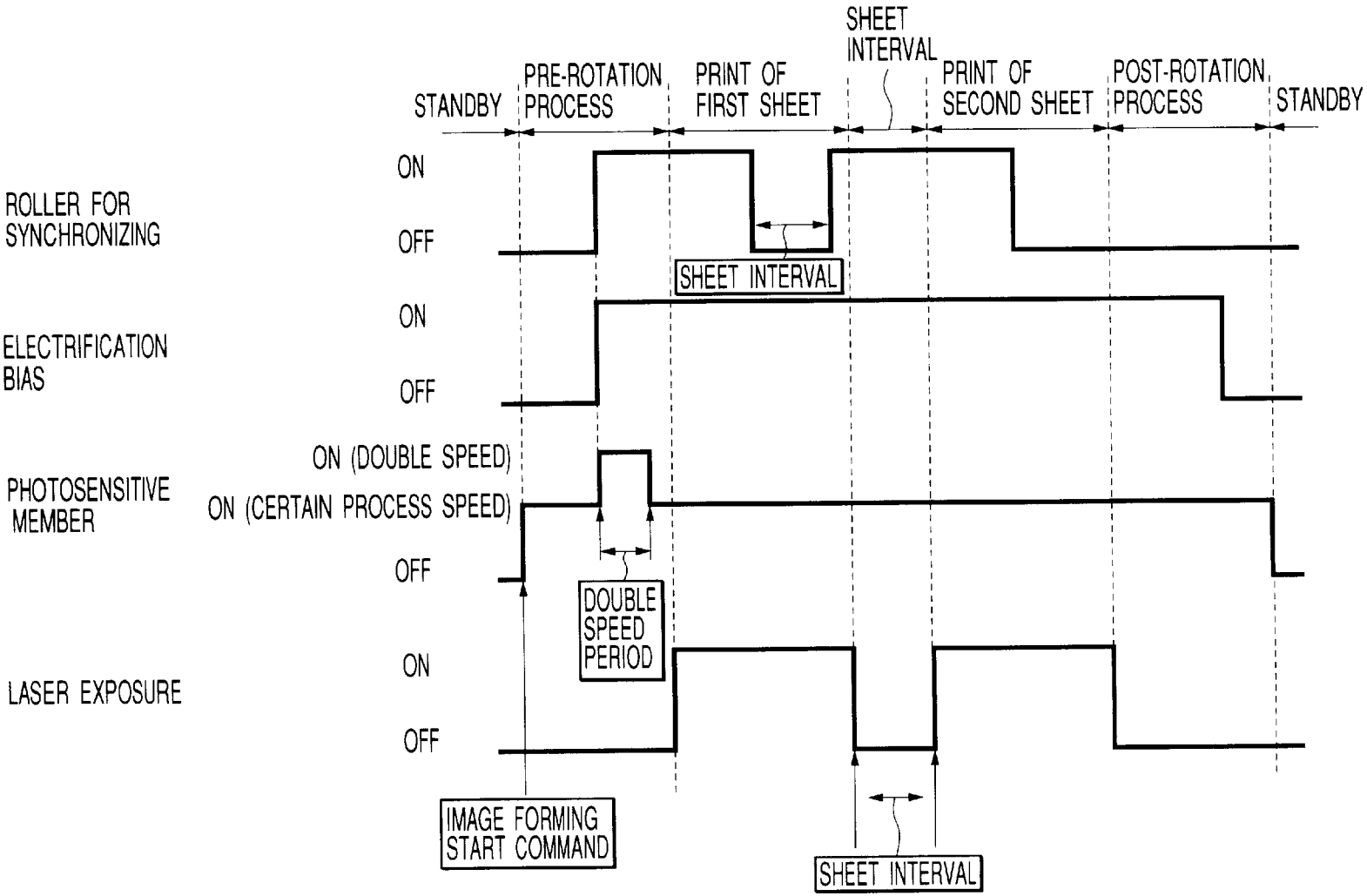
FIG. 8 is a timing chart (in 1 to 2) at the time of image formation in accordance with Embodiment 2.

FIG. 8 is a timing chart relating to this embodiment (1 to 2).

In this structure, image formation in 1 to 1 is first conducted using the original with a printing ratio of 6%. As a result, the electrification time per A4 traverse sheet is about 2.4 sec. However, the abrasion amount per 10,000 sheets is approximately 2.5 μm, and there is almost no difference in the amount between Embodiment 1 and this embodiment. This is because the substantial electrification area is the same even if the electrification time is shortened.

In Embodiment 1, the electrification time required for conducting formation of an image on a A4 traverse sheet of the recording material is (A)+(B)+(C)=about 2.7 sec as the total of (A) before image formation: 0.63 sec, (B) at the time of image formation: 1.4 sec, and (C) after image formation: 0.63 sec. On the other hand, in this embodiment, since the electrification for the period of one peripheral length before image formation is conducted at double the process speed in Embodiment 1, that is, 300 mm/sec, the time required for electrification for one peripheral length, which is performed before image formation, is 94.2/300=0.314 sec (A'). Thus, (A')+(B)+(C)=about 2.4 sec.

Next, similarly, when the image formation in 1 to N is conducted, the same result as in Embodiment 1 is obtained. For example, image formation for 92 thousands sheets is possible in 1 to 2.

Further, in this embodiment, the distance L between the transfer nip portion 7*c* and the pair of rollers for synchronizing 50 is 100 mm. Thus, the time required for discharging the first recording material P at the time of image formation in 1 to N can be shortened by about 0.3 sec in comparison with Embodiment 1. Therefore, a decline in the productivity can be prevented.

By the way, the peripheral velocity of the photosensitive member 1 is increased to 300 mm/sec for a predetermined time in this embodiment. However, the rate of velocity increase is not limited to the numerical value in this embodiment. Of course, the optimum rate of increase varies according to a system and kind of the photosensitive member, a system and kind of the electrifying member, the process speed, and the like.

Further, $t\mathbf{0}=0.47$ sec and $t\mathbf{1}=0.67$ sec are set in this embodiment, but the same effect can be obtained as long as $t\mathbf{0} \leqq t\mathbf{1}$ is satisfied. However, it is desirable that $t\mathbf{1} \leqq 2 \times t\mathbf{0}$ is satisfied taking the effect of saving space and the productivity of the apparatus into consideration. More preferably, it is practically most suitable that t0 and t1 are substantially the same.

Further, the peripheral velocity of the photosensitive member 1 is changed in this embodiment. However, the same effect can be obtained also when the speed at which the recording material P moves from the position of the pair of rollers for synchronizing 50 to the transfer nip portion 7*c* is made variable. For example, in this embodiment, also in the case where the speed at which the tip end of the first recording material P moves from the position of the pair of rollers for synchronizing 50 to the transfer nip portion 7*c* is set at half the process speed, that is, 75 mm/sec, the same effect can be obtained.

Moreover, of course, control may be conducted at the optimum speed by suitably combining these configurations.

Also, in the case where, besides the processing such as accumulation and expansion of the input image data input to the image forming apparatus as described in Embodiments 1 and 2, image formation is caused to wait until the temperature of the fixing apparatus reaches a level required for effecting fixation, or in the case where image formation is caused to wait until the completion of expansion of the input image data in case of using the image forming apparatus as a printer, excessive electrification of the photosensitive member is prevented by applying Embodiments 1 and 2. As a result, power consumption of the electrification power source can be reduced, occurrence of the image defect and lowering of the photosensitive member life can be prevented, and the number of sheets for which image formation can be performed per unit time, that is, productivity can be maintained as well.

[Other Embodiments]

In the image forming apparatus in an embodiment, the contact electrifying member 2 is not limited to a roller type, and may be a contact electrifying member with other form, such as blade type, rod type, brush type or magnetic brush type.

The structure may also be adopted in which, as described above, the electrifying member and the image bearing member surface are not in contact with each other with pressing force but are arranged extremely close to, yet not in contact with, each other provided that a dischargeable area determined by a gap to gap voltage and a Paschen curve is secured between both the members. In the present invention, this also falls under the category of contact electrification.

As a waveform of an alternating voltage, a sine wave, a rectangular wave, a triangular wave or the like can be appropriately used.

Instead of the alternating voltage, a constant voltage or a direct current electric field that has undergone a constant-current control can also be used.

As the image exposure means, other appropriate exposure means or mechanism can be used such as a slit exposure means of an original image.

It is not inconvenient that the developing system is a normal developing system. The contact electrification system transferring means is a conductive transferring roller in the above-described embodiments, but is not limited to a roller type. Other rotary members of a belt type or the like can also be used. A transfer corona discharge device may also be used.

The image bearing member may be an electrostatic recording dielectric or the like. In this case, the dielectric surface is primarily electrified uniformly to predetermined polarity and potential, and then selectively charge-removed by a charge-removal means such as a charge-removal stylus head or an electronic gun, to thereby form a target electrostatic latent image on the dielectric surface.

As described above, according to the above structure, consumption power necessary for electrification of the image bearing member can be reduced as much as possible irrespective of the image forming mode, the amount of input image data, or the like. Further, a satisfactory image without density unevenness and the like can be provided with high productivity, and thus, the service life of the image bearing member can be improved.

What is claimed is:

1. An image forming apparatus comprising:

an image bearing member, which is rotatable;

electrifying means for electrifying said image bearing member;

image forming means for forming an electrostatic image on said image bearing member electrified by said electrifying means;

developing means for developing the electrostatic image with toner;

transferring means for transferring a toner image formed on said image bearing member to a recording material;

conveying means for causing the recording material to wait for a time and be synchronized so as to convey the recording material toward a transfer portion of said transferring means, wherein a difference between (i) a distance from a conveyance start position of said conveying means to a transferring position of said transferring means and (ii) a distance from an electrifying position of said electrifying means to a transferring position of said transferring means is equal to or more than a peripheral length of said image bearing member; and control means for controlling a start timing of electrification by said electrifying means in accordance with a start timing of a conveyance of the recording material by said conveying means.

2. An image forming apparatus according to claim 1, wherein a waiting time of the conveyance of the recording material by said conveying means is variable in accordance with an image forming mode.

3. An image forming apparatus according to claim 2, further comprising processing means for image-processing input image data, wherein said image forming means is provided with exposure means for exposing said image bearing member on the basis of output image data that has been image-processed by said processing means.

4. An image forming apparatus according to claim 3, wherein the waiting time is longer in a case where the input image data is output to said exposure means after being processed by said processing means than the waiting time in a case where the input image data is output to said exposure means without having been processed by said processing means.

5. An image forming apparatus according to claim 3, wherein the waiting time is variable in accordance with a number of density levels of the output image data with respect to the input image data.

6. An image forming apparatus according to claim 1, wherein a waiting time of the conveyance of the recording material by said conveying means is variable in accordance with an amount of input image data.

7. An image forming apparatus according to claim 6, further comprising processing means for image-processing input image data, wherein said image forming means includes exposing means for exposing said image bearing member on the basis of the image data that has been image-processed by said processing means, and wherein a processing time by said processing means varies in accordance with the amount of input image data.

8. An image forming apparatus according to claim 1, wherein a bias in which an AC bias is superimposed on a DC bias is applied by said electrifying means to said image bearing member in a state in which said electrifying means contacts said image bearing member.

9. An image forming apparatus according to claim 1, wherein said control means starts the electrification by said electrifying means after the start of the conveyance of the recording material by said transferring means.

10. An image forming apparatus according to claim 1, wherein a waiting time of the conveyance of the recording material by said conveying means is variable.

* * * * *